US007066333B2

(12) United States Patent
Justice

(10) Patent No.: US 7,066,333 B2
(45) Date of Patent: Jun. 27, 2006

(54) OFFICE PAPER END-DISPLAY SHIPPER DISPLAY

(75) Inventor: Timothy J Justice, Williston, TN (US)

(73) Assignee: International Paper Company, Stamford, CT (US)

( * ) Notice: Subject to any disclaimer, the term of this patent is extended or adjusted under 35 U.S.C. 154(b) by 90 days.

(21) Appl. No.: 10/431,883

(22) Filed: May 8, 2003

(65) Prior Publication Data

US 2003/0222131 A1 Dec. 4, 2003

Related U.S. Application Data

(60) Provisional application No. 60/374,087, filed on Jun. 4, 2002.

(51) Int. Cl.
*B65D 75/58* (2006.01)
*B65D 17/28* (2006.01)

(52) U.S. Cl. ..... 206/738; 206/774; 229/235; 229/242

(58) Field of Classification Search ..... 206/736, 206/738, 754, 45.2–45.21, 45.24, 45.25, 206/774; 229/235, 238, 240, 242, 164
See application file for complete search history.

(56) References Cited

U.S. PATENT DOCUMENTS

| | | | | | |
|---|---|---|---|---|---|
| 2,228,377 | A | * | 1/1941 | Wendt, Jr. | 206/766 |
| 2,259,041 | A | * | 10/1941 | Larkin | 206/766 |
| 2,271,258 | A | * | 1/1942 | Henderson | 206/766 |
| 2,790,542 | A | | 4/1957 | Hillman | |
| 2,930,516 | A | | 3/1960 | Fowle et al. | |
| 3,076,590 | A | | 2/1963 | Petryk et al. | |
| 3,178,242 | A | | 4/1965 | Ellis et al. | |
| 3,307,770 | A | | 3/1967 | Wysocki | |
| 3,367,487 | A | | 2/1968 | Dwyer, Jr. | |
| 3,469,766 | A | * | 9/1969 | Nelson | 229/235 |
| 3,761,012 | A | | 9/1973 | Rosenburg, Jr. | |
| 4,000,811 | A | | 1/1977 | Hardison et al. | |
| 4,008,849 | A | * | 2/1977 | Baber | 229/237 |
| 4,553,666 | A | * | 11/1985 | Gullikson | 229/112 |
| 5,167,324 | A | | 12/1992 | Miller | |
| 5,622,309 | A | | 4/1997 | Matsuda et al. | |
| 2002/0043554 | A1 | | 4/2002 | White et al. | |

* cited by examiner

*Primary Examiner*—Jila M. Mohandesi
(74) *Attorney, Agent, or Firm*—Daniel C. Stelter

(57) ABSTRACT

A shipping container converts into a display tray, wherein the container has a base and a removable lid, and a single tear line crosses a plurality of side, end and bottom panels of the base, dividing the base into two sections of unequal size. The smaller section of the base is removed and discarded, leaving the larger section as the display tray.

16 Claims, 6 Drawing Sheets

OFFICE PAPER END-DISPLAY SHIPPER DISPLAY

RELATED APPLICATION

This application claims priority from U.S. Provisional Application Ser. No. 60/374,087, filed Jun. 4, 2002.

FIELD OF THE INVENTION

The present invention relates to a corrugated container, erected from a unitary paperboard blank, for the holding, stacking and transporting of items such as reams of paper. In particular, the present invention relates to a container wherein a base has two side panels, two end panels, a bottom panel, and a perforated score line for tearing that crosses a plurality of the container's panels and outlines a removable section that includes at least one entire end panel.

BACKGROUND OF THE INVENTION

Corrugated paperboard is typically used in many different applications, for example, to form containers, boxes, cartons or dividers for holding, storing, stacking or shipping various items, such as reams of paper utilized in copiers and printers.

Typically, such containers have a bottom, four side walls and a removable lid, and are formed from blanks indented with score lines or cut lines, wherein the container's base and removable lid each are erected from separate blanks. Each blank is most often scored by automated machines in a continuous in-line process involving cutting, scoring and molding continuous sheets of paperboard. The paperboard is then erected by the automated machines along the score lines or cut lines to form the base or the removable lid. Alternatively, the blanks may be erected into a container by a consumer or other manual means. For full assembly of the container, once the lid and base have been erected, the removable lid is placed over the base in a secure yet non-bonded manner.

Frequently, containers are utilized for holding commercial products that are shipped to retail stores and outlets for the sale and display of the contained products. With a basic container, when the retail establishment wishes to display the products held inside, an on-site user must open the container, remove the products, and place the products on a display tray or stand, which can be a time consuming process. Thus, retail establishments often prefer a shipping container that can be converted into a display tray. This enables a user to display the goods quickly on a shelf without first removing the products from the container and can create impromptu and self-sufficient display trays where no such means previously existed, thereby saving costs.

With respect to the shipping of reams of office paper, converting a container to a display tray is problematic. Usually, such containers that are designed to convert into a display tray have a single side panel that is scored or perforated. To convert the container, the lid is removed and discarded. The perforated side panel is then torn and removed from the base, displaying the paper inside. However, a perforation along a side wall of the container's base is not an optimal solution. First, excessive perforation along a single side panel results in compromised integrity of the container along that side panel, reducing the overall strength of the container. Second, tearing away a single side panel often tears away more of the container than intended, resulting in torn or frayed edges, and a generally unattractive display.

Further, in convertible containers, access to the lowest item held within the container after it has converted into a display tray is often limited by the bottom panel of the container. For example, if a user wants to remove a ream of paper that is lying on the bottom panel of a container, the user will not be able to access the ream from the ream's bottom side since the bottom panel will block all lower access. Thus, it will be difficult for a user to grip the ream without first leveraging at least a part of the ream upward. Such leveraging is usually done by pushing a side of the ream and moving the side tangentially upward until lower access can be achieved, which can be a cumbersome process.

Therefore, it is an object of this invention to provide a convertible paperboard shipper display container that does not significantly compromise the strength of a container's side panel with perforated lines and allows for easy and clean tearing of the paperboard container while potentially providing bottom side access to the items held within the container.

SUMMARY OF THE INVENTION

The present invention comprises a shipping container that can be readily and easily converted into a display tray by tearing along a tear score line scored in the container's base across a plurality of side panels and outlining a section including at least one entire side panel. Having a tear score line cross a plurality of side panels improves the strength of the box by eliminating heavy scoring of any one single side panel's surrounding score lines. Further, a tear score line that crosses a plurality of panels including the bottom panel in the base is provided, outlining a section that includes at least one entire side panel and creating bottom access to items held within the container.

The container base is formed from a blank having two opposing side panels and two opposing end panels foldably connected to a bottom panel along fold lines, and two opposing end flaps foldably attached to each side wall. The tear score line crosses the entire base from an outer or upper edge of one side panel to an outer or upper edge of the opposing panel, wherein the tear score line extends across the bottom panel or extends along at least one fold line that separates the bottom panel from one of the opposing end panels, dividing the base into two sections of unequal size. The smaller, removable section contains portions of two opposing side walls and one entire end wall to provide complete frontal access to the goods held within. The container may further comprise a removable lid having a top panel and four side panels foldably attached to the top panel along fold lines.

A tear strip or filament, commonly known as tear tape, may be attached to the container along an inner surface of the tear score line to facilitate clean and easy tearing. The tear tape may further contain a tear flap attached to an end of the tear score line that extends outwardly from the container, enabling a user to grip and access the tear tape for the purpose of tearing.

A display case or tray is created by first removing the removable lid if necessary. Next, the tear score line is torn and the smaller section of the container outlined by the tear score line is removed and discarded. Since at least a portion of three walls is removed, the contents of the container are visible and accessible on three sides. The tear may further involve tearing part of the bottom panel of the container even if items are being held within the container, providing accessibility to the contents on an additional, lower side. The remaining art of the container becomes a display tray that comprises the entirety of one end wall and major portions, but not all of, both side walls, and at least a majority of the bottom panel.

Other objects, embodiments, features and advantages of the present invention will be apparent when the description of a preferred embodiment of the invention is considered in conjunction with the annexed drawings, which should be construed in an illustrative and not limiting sense.

BRIEF DESCRIPTION OF THE FIGURES/ DRAWINGS

DETAILED DESCRIPTION

Figure 1:
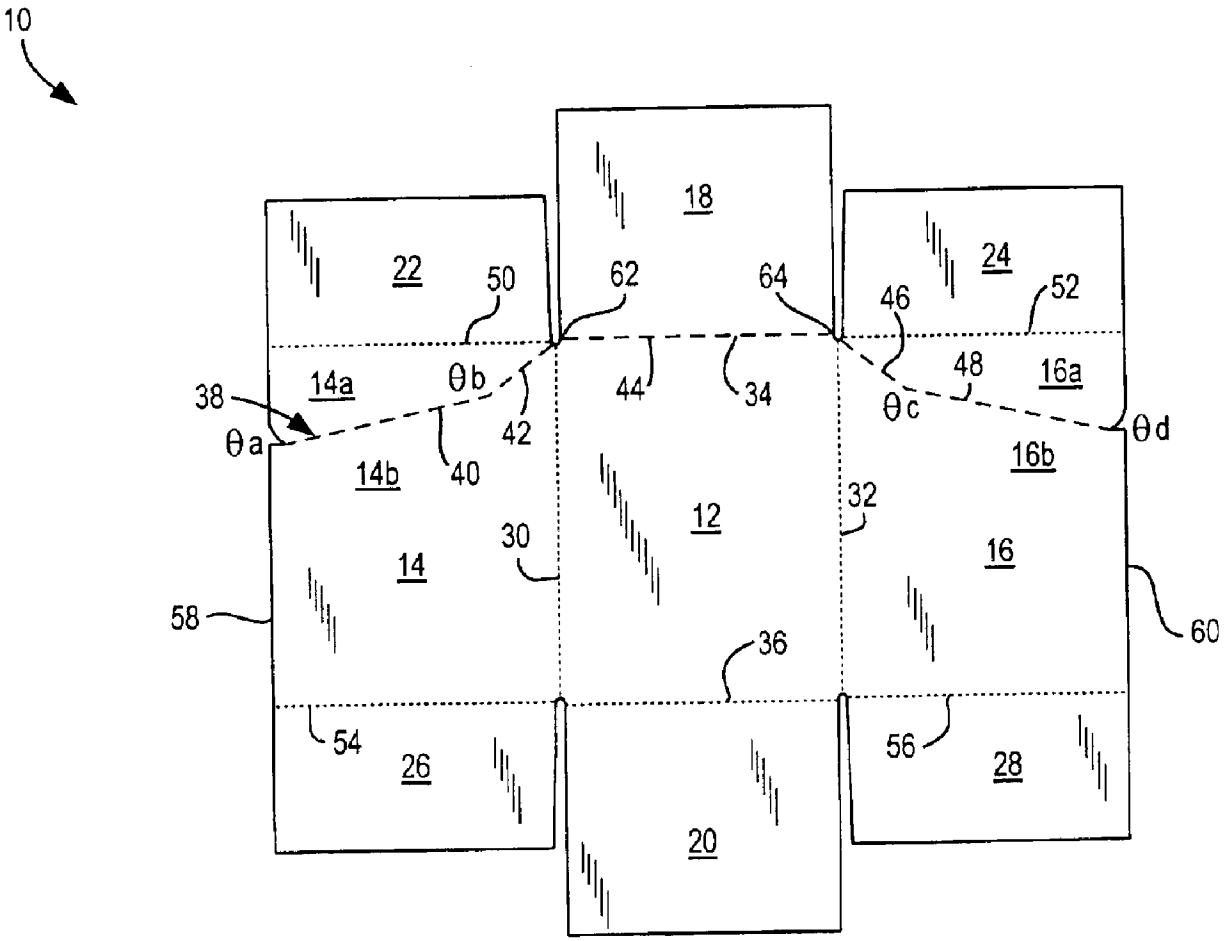
FIG. 1 is a plan view of a blank for forming a container base that can be converted into a display tray.

A paper or paperboard blank 10 that can be erected into a container is shown in FIG. 1. The blank is preferably a flat material of single or multi-ply thickness made of any material known, such as corrugated paper or paperboard, that is suitable for shipping, stacking and transporting a variety of items. Bottom panel 12 is a large, rectangular panel, preferably of sufficient size to support a ream of office, printer or copier paper, or multiple reams stacked on top of one another. Parallel side fold lines 30 and 32 border the bottom panel on two opposing side edges, and parallel end fold lines 34 and 36 border the bottom panel on two opposing end edges.

Side panels 14 and 16 foldably connect to bottom panel 12 along side fold lines 30 and 32, respectively. Likewise, end panels 18 and 20 foldably connect to bottom panel 12 along end fold lines 34 and 36, respectively.

Each side panel is bordered by fold lines that outline bottom panel 12, an outer edge (which is the upper edge in a container erected from the blank), and two end flaps foldably connected on opposite ends of the side panel along fold lines. Thus, side panel 14 is bordered by fold line 30, outer edge 58 and flaps 22 and 26 which foldably connect to the side panel along fold lines 50 and 54, respectively. Side panel 16 is bordered by fold line 32, outer edge 60 and flaps 24 and 28 which foldably connect to the side panel along fold lines 52 and 56, respectively.

Tear score line 38 divides blank 10 into two sections of unequal size by crossing the blank from outer edge 58 to outer edge 60 such that the entire score line can be torn with a single tear. In a preferred arrangement, score line 38 extends from outer edge 58 at an angle θa toward fold line 30. After crossing the majority of panel 14, the score line changes to an angle θb that is more acute than angle θa as it relates to outer edge 58, directly towards an intersection 62 of fold lines 30, 34 and 50. However, any combination of angles or arcuate turns can be scored onto panel 14, as long as the score line ends up at intersection 62. Essentially, the score line can cross from any point on outer edge 58 intermediate score line 50 and 54 to intersection 62. As such, angle θb is not necessary if angle θa leads the tear score line directly into intersection 62. Therefore, a wide range of angles may be substituted for angles θa, or θa and θb.

In the embodiment shown in FIG. 1, side panel 14 is divided by score line segments 40 and 42 into a smaller section 14*a* and a larger section 14*b*. Segment 44 of score line 38 then extends from intersection 62 directly on end fold line 34 toward an intersection 64 of fold lines 32, 34 and 52. Upon reaching intersection 64, the tear score line angles across side panel 16 toward outer edge 60 intermediate score lines 52 and 56. Just like the division of panel 14, score line 38 may cross side panel 16 by any angle and/or combination of angles or arcuate turns, as long as the score line extends from some point on fold line 46 to some point on outer edge 60 without extending along fold line 52. For aesthetic reasons, it is preferred that angles θc and θd on tear line segments 46 and 48 are the same as angle θa and θb, but this is not a required feature to achieve the invention's functionality. In the present embodiment, panel 16 is divided by tear score line segments 46 and 48 into smaller section 16*a* and larger section 16*b*.

The tear score line can be either a perforated score line by itself or a perforated score line with a tear tape attached to it. The tear tape may be any tape or tearing filament well known in the art for the purpose of tearing a flexible material such as paperboard. Such tape enables a user external to the container to fully tear through the thickness of the container when the tear tape is pulled. The tear tape may further contain a tear tab that is integrally connected to one side of the tear tape and extends outwardly from the edge of the container, enabling a user to better grip the tear tape prior to and during the tearing process. Tear cut lines may also be scored to facilitate the tear.

Referring to FIG. 1, tear score line 38 divides the entire container blank into two sections. The smaller section comprises panels 14*a*, 16*a*, 18, 22 and 24. This section is removed and discarded when the container is erected and converted into a display tray. The larger section comprises the entirety of bottom panel 12 and panels 14*b*, 16*b*, 20, 26 and 28, and corresponds to the display tray when the container is erected and torn along tear line 50.

To erect blank 10 into a container C, the blank is preferably folded along the fold lines and erected by a machine in a continuous in-line process. Blank 12 is first folded along the horizontal axis of fold lines 30 and 32, lifting side panels 14 and 16 and end flaps 22, 24, 26 and 28 upwards, out of the horizontal plane of bottom panel 12. End flaps 22, 24, 26 and 28 are then folded 90° along the vertical axis of fold lines 50, 52, 54 and 56, respectively, towards the bottom panel. Finally, end flaps 18 and 20 are folded upwards along horizontal fold lines 34 and 36 and are adhered to the back sides of the end panels with an adhesive. The adhesive used can be any adhesive known in the art for the purpose of bonding corrugated paper together. Alternative embodiments include utilizing non-adhesive bonding materials, such as staples, to erect and secure the container.

Blanks of alternate sizes, or with different size ratios of the individual panels of the blanks than those depicted in FIG. 1, can be easily achieved while maintaining the spirit of the invention. For example, thinner objects can be accounted for by changing the lengths of the side and end panels. Smaller items can be accounted for by adjusting the size of the bottom panel.

Figure 2:
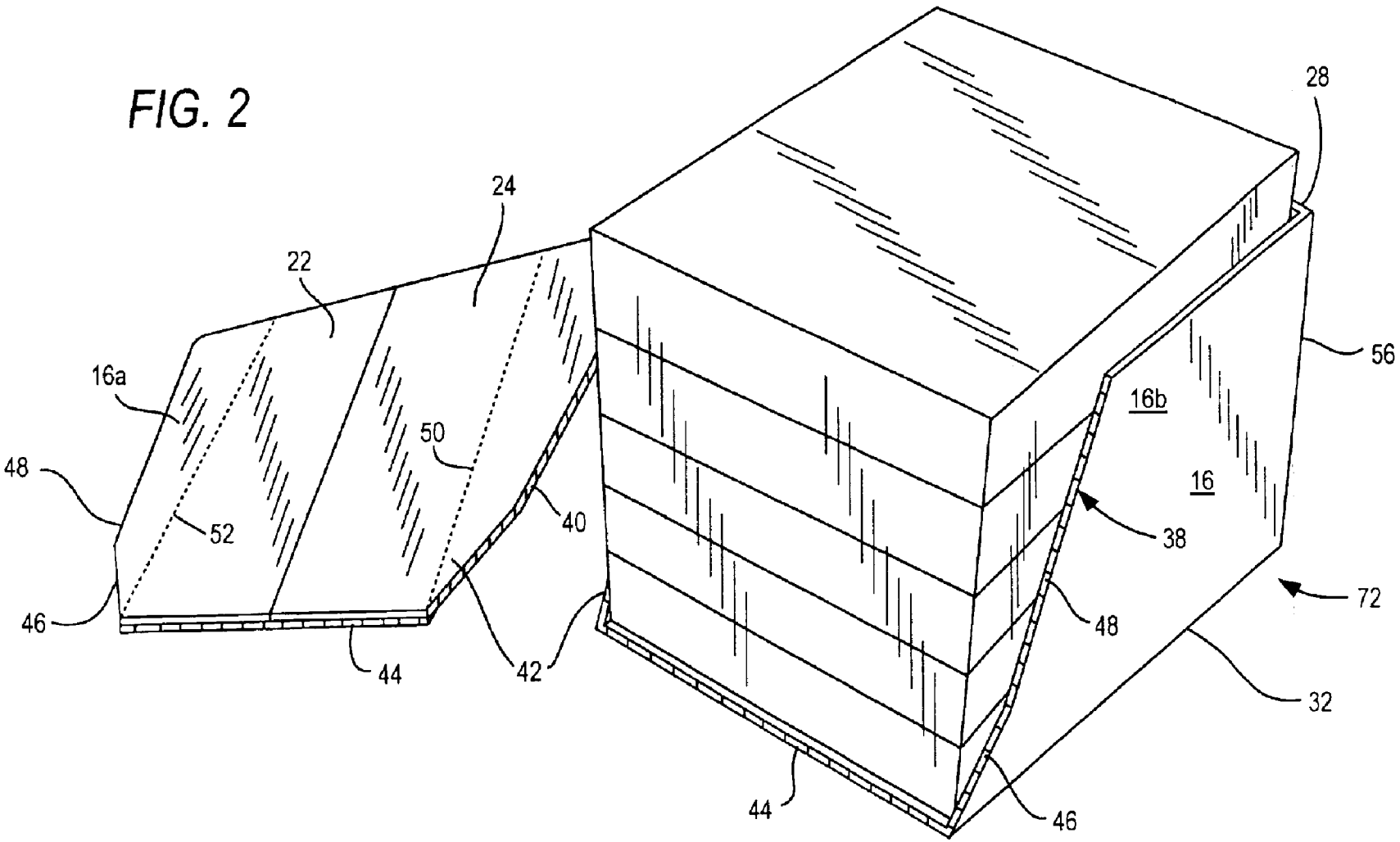
FIG. 2 is a perspective view of the container erected from the blank in FIG. 1 being converted into a display tray.

The display tray is created by tearing the tear score line of a container erected from blank 10, as shown in FIG. 2. The score tear line is torn across a plurality of panels in a single, continuous motion extending from one side of the container to the opposing side. The tear motion may be aided by a tear tape or a tear flap connected to one side of the tear tape to facilitate the tear by aiding the grip of the user. The final display tray 72 remains after tearing. The tray 72 comprises the entirety of the lid's bottom panel, the entirety of one end wall, and parts of two opposing side walls. The front wall of the tray is completely removed. The entire front and portions of the sides of the container's contents are visible and accessible, providing multiple display and access points for the goods.

Figure 3:
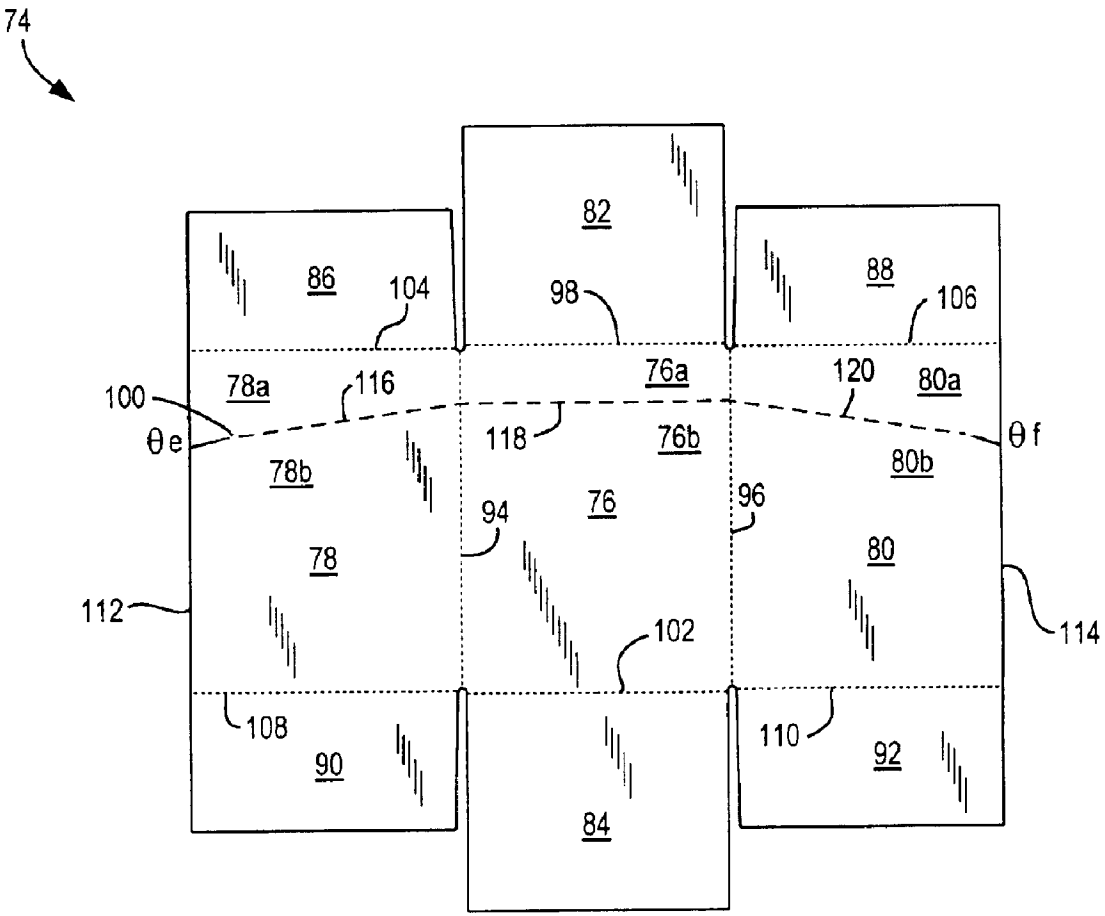
FIG. 3 is a plan view of an alternate embodiment of a blank for forming a container base that can be converted into a display tray.

An alternate embodiment of a blank scored in accordance with the invention is shown in FIG. 3. Blank 74 is largely similar to blank 10, but score line 100 traverses bottom panel 76 instead of extending along one end fold line of the panel. Blank 74 is made of any material known, such as corrugated paper or paperboard, that is suitable for shipping, stacking and transporting a wide variety of items, and comprises bottom panel 76, side panels 78 and 80 foldably connect to bottom panel 76 along fold lines 94 and 96, respectively, and end panels 82 and 84 foldably connect to bottom panel 76 along fold lines 98 and 102, respectively. Side panel 78 has outer edge 112 and flaps 86 and 90 that foldably connect to the side panels along fold lines 104 and 108, respectively, while side panel 80 has outer edge 114 and side flaps 88 and 92 that foldably connect to the side panel along fold lines 106 and 110, respectively.

Tear score line 100 divides blank 10 into two sections of unequal size by traversing the blank from outer edge 112 to outer edge 114 such that the entire score line can be torn with a single tear. In this embodiment, score line 100 extends from outer 112 at an angle θe toward fold line 94, forming score line segment 116. The exact angle of θe can vary widely within the scope of the invention. Further, segment 116 could be arcuate or segmented by having the tear score line angle part way through side panel 78, like score line 38 in FIG. 1. Essentially, segment 116 may extend in any arrangement from a point on outer edge 112 intermediate fold lines 104 and 108 to a point on fold line 94 intermediate fold lines 98 and 102, with angle θe varying accordingly. As a result, a wide range of angles may be substituted for angle θe.

In the embodiment shown in FIG. 3, side panel 78 is divided by tear score line segment 116 into a smaller section 78*a* and a larger section 78*b*. Tear score line 100 then traverses bottom panel 76, dividing the panel into smaller section 76*a* and larger section 76*b*. This piece of the tear score line is segment 118 and is preferably (although not necessarily) parallel to fold line 98 and closer to fold line 98 than fold line 102. Upon reaching a point on fold line 96 intermediate fold lines 98 and 102, the tear score line angles across side panel 16 toward outer edge 114. Just like the division of panel 78, segment 120 of tear score line 100 may cross side panel 16 by any angle or combination of angles or arcuate turns, as long as the score line extends from some point on fold line 96 intermediate the end fold lines to some point on outer edge 114 intermediate fold lines 106 and 110. For aesthetic reasons, it is preferred that angle θf of tear score line segments 120 is the same as angle θe, but this is not a required feature to achieve the invention's functionality. In the present embodiment, panel 80 is divided into smaller section 80*a* and larger section 80*b*.

Figure 4:
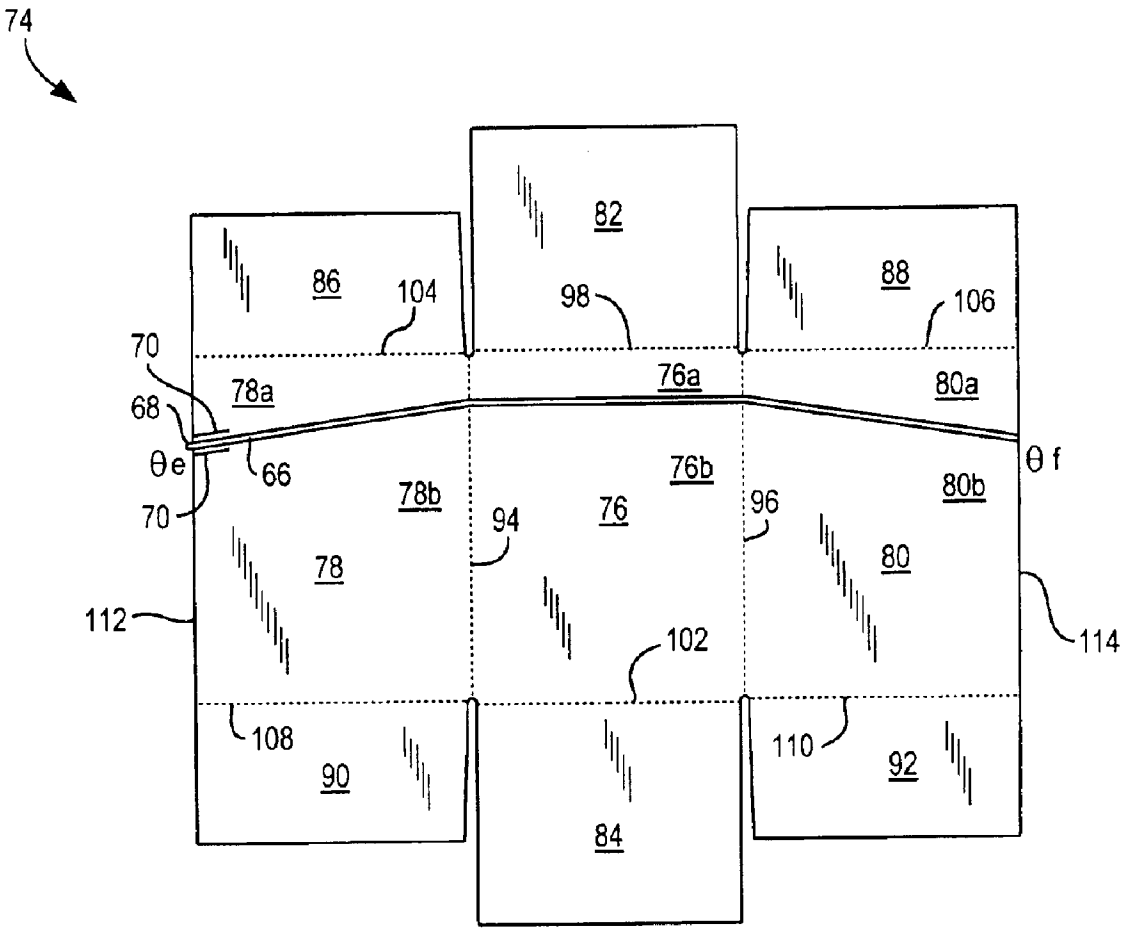
FIG. 4 is a plan view of a paperboard blank of FIG. 3 with a tear filament over a tear score line.

The tear score line can be either a perforated score line by itself, or a perforated score line with a tear tape attached to it, as shown in FIG. 4. Tear tape 66 is any tape or tearing filament well known in the art for the purpose of tearing a flexible material such as paperboard. Such tape enables a user external to the container to fully tear through the thickness of the container when the tear tape is pulled. Ideally, the tear tape is attached to the inner surface of the tear score line to facilitate a complete tear, the inner portion of the tear score line being the portion of the score line that is only visible from the interior of the container when the lid is removed. The tear tape may also contain tear tab 68 that is integrally connected to one side of the tear tape and extends outwardly from the edge of the container, enabling a user to better grip the tear tape prior to and during the tearing process. Tear cut lines 70 may also be scored to facilitate the tear. In other embodiments, the container may contain tear tape 66 without tear score line beneath it.

Referring to FIG. 3 again, tear score line 100 divides the entire container blank into two sections. The smaller section comprises panels 76*a*, 78*a*, 80*a*, 82, 86 and 88. This section is removed and discarded when the container is erected and converted into a display tray. The larger section comprises panels 76*b*, 78*b*, 80*b*, 84, 90 and 92, and corresponds to the display tray when the container is erected and torn along tear line 100. Blank 74 is erected in the same manner as blank 10, preferably by a machine in a continuous in-line process.

Figure 5:
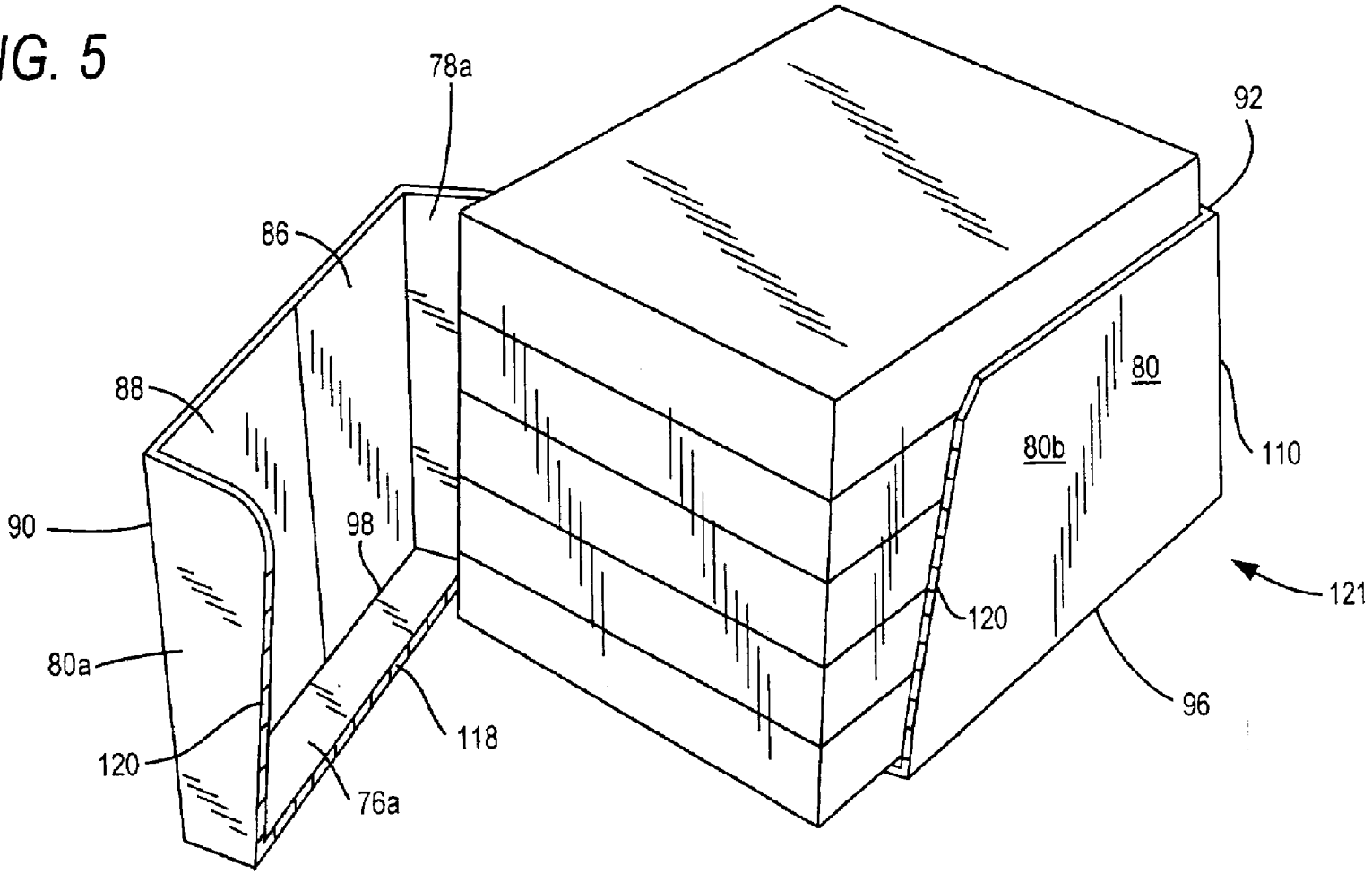
FIG. 5 is a perspective view of the container erected from the blank in FIG. 3 being converted into a display tray.

The display tray is created by tearing the tear score line as shown in FIG. 5. The score tear line is torn across a plurality of panels in a single, continuous motion extending from one side of the container to the opposing side. In this embodiment, a portion of the bottom panel can be torn along the tear score line even if the bottom panel is lying flat on a ground or table surface and the container is full of items or goods. The tear motion may be aided by a tear tape or a tear flap connected to one side of a tear tape to facilitate the tear by aiding the grip of the user. A final display tray 121 remains after tearing. The tray 121 comprises a majority of the lid's bottom panel, the entirety of one end wall, and parts of two opposing side walls. The end wall of the tray is completely removed. The entire front and most of the side of the container's contents are visible and accessible, providing multiple display and access points for the goods. Further, a portion of the bottom panel is removed, providing bottom access to the lower items held within the container.

Figure 6:
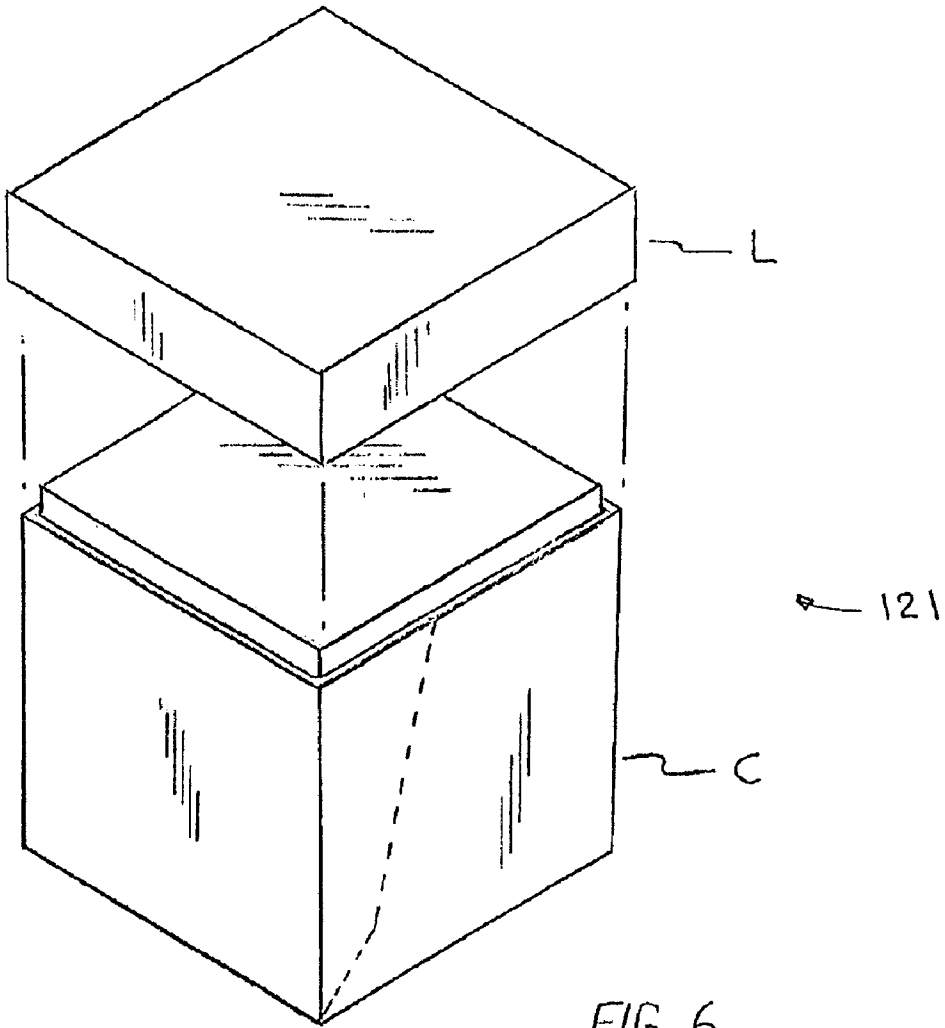
FIG. 6 is an exploded perspective view of a shipping and display container and associated lid according to the invention.

A container C and associated lid L are indicated generally at 122 in FIG. 6.

While the preferred embodiments of the invention have been illustrated and described, it will be appreciated that various changes can be made therein without departing from the spirit and scope of the invention. Although the invention has been described with reference to preferred embodiments, it will be appreciated by one of ordinary skill in the art that numerous modifications are possible in light of the above disclosure. For example, this display tray may have side walls that extend higher to increase the protection of the goods inside. Similarly, in FIG. 3., the tear score line segment 118 may be closer to or further away from end fold line 98. All such variations and modifications are intended to be within the scope and spirit of the invention as defined in the claims appended hereto.

I claim:

1. In a container for shipping and displaying objects, wherein the container has a base with an open top and a separate, removable lid for closing the open top, wherein the base has a bottom panel, opposing end walls foldably attached to the bottom panel along opposing end fold lines, and opposing first and second side walls foldably attached to the bottom panel along opposing side fold lines, each of the opposing end walls having a free upper edge and two opposing side edges, and each of the opposing side walls having a free upper edge and opposite end edges, and an inwardly folded end flap on each of the opposite end edges of the side walls, the improvement comprising:

a continuous, uninterrupted tear score line extending downwardly at an angle from a first point on the free upper edge of said first of said side walls, across an end portion of said first side wall to the side fold line joining that side wall to the bottom panel, and across an adjacent end of the bottom panel to the side fold line joining said second side wall to the bottom panel, and upwardly at an angle across an end portion of the second of the opposing side walls to a second point on the free upper edge of said second side wall, whereby when said tear score line is fractured a minor end portion of each of said side walls and the entirety of said one end wall are removed, defining a display container having a completely open top, one completely open end, and a minor end portion of each of said side walls open to expose an end and part of the sides of said objects.

2. The container according to claim 1, wherein the tear score line extends from the upper edge of the first of the opposing side walls to the upper edge of the second of the opposing side walls, in part, along a first of the opposing end fold lines.

3. The container according to claim 1, wherein the tear score line traverses the bottom panel intermediate the opposing end fold lines, closer to one said end fold line than to the other, whereby a portion of the bottom of objects supported in the container is exposed to facilitate removal of the objects from the container.

4. The container according to claim 1, further comprising a tear tape extending along the tear score line on an inner surface of the container.

5. The container according to claim 4, wherein the tear tape further comprises at least one tear flap attached to at least one end of the tear tape, wherein at least a portion of the at least one flap extends outwardly from the container.

6. A container as claimed in claim 1, wherein:

the objects comprise wrapped reams of paper.

7. A unitary blank for forming a shipping and display container, comprising:

a bottom panel;

opposing end panels foldably attached to the bottom panel along respective opposing end fold lines;

opposing side panels foldably attached to the bottom panel along respective opposing side fold lines;

each of the opposing side and end panels having a free outer edge, said side panels each having two opposing end edges, and an end flap foldably joined to each end edge of each side panel; and a continuous, uninterrupted tear score line extending diagonally across an end portion of a first of said side panels from a point on the free outer edge of said first side panel intermediate the opposing end edges thereof, across an end of said bottom panel, and diagonally across an end portion of a second of said side panels to a point on the free outer edge of said second side panel intermediate the opposing end edges thereof, said points being closer to one end edge of the respective side panels than to the other end edge, whereby when the tear score line is fractured in a container erected from said blank, minor end portions of said side panels and an entirety of one end panel are removed.

8. The unitary blank according to claim 7, wherein the tear score line extends from the outer edge of the first of the opposing side panels to the outer edge of the second of the opposing side panels, in part along a first of the opposing end fold lines.

9. The unitary blank according to claim 7, wherein the tear score line traverses the bottom panel intermediate the opposing end fold lines.

10. The unitary blank according to claim 7, wherein the tear score line extends, in part, diagonally from the outer edge of the first opposing side panel to a first of the opposing side fold lines and diagonally from the outer edge of the second opposing side panel to a second of the opposing side fold lines.

11. The unitary blank according to claim 7, further comprising a tear tape extending along the tear score line on an inner surface of the unitary blank.

12. The unitary blank according to claim 11, wherein the tear tape further comprises at least one tear flap attached to at least one end of the tear tape, wherein at least a portion of the at least one flap extends outwardly from the unitary blank.

13. A method for converting a shipping container into a display tray, wherein the container comprises a base having an open top, and a separate, removable lid, and wherein said container base has a bottom panel, two opposing side walls foldably joined to opposite side edges of the bottom panel, and two opposing end walls foldably joined to opposite end edges of said bottom panel, said side and end walls each terminating in a free upper edge, said method comprising the steps of:

tearing a continuous, uninterrupted score line downwardly at an angle from a free upper edge of a first side wall of the container toward an adjacent end wall, across one end of the bottom panel, and upwardly at an angle to a free upper edge of an opposing second side wall of the container with a single tear to form a disposable portion of the container base comprising minor end portions of the first and second side walls and an entirety of a first end wall; and removing the disposable portion of the container to expose an end portion of articles contained in the container.

14. The method according to claim 13, wherein the disposable portion further comprises a minor end portion of the bottom panel of the container.

15. The method according to claim 13, wherein a tear tape is pulled to tear the score line.

16. The method according to claim 15, wherein at least one tear tab is integrally attached to at least one end of the tear tape, providing a grip to tear the tear score line.

* * * * *